US006748626B2

(12) United States Patent
Maurer

(10) Patent No.: US 6,748,626 B2
(45) Date of Patent: Jun. 15, 2004

(54) ARTICULATED SWING AWAY HINGE

(76) Inventor: Scott D. Maurer, 16 Hidden Valley, Rocky River, OH (US) 44116

( * ) Notice: Subject to any disclaimer, the term of this patent is extended or adjusted under 35 U.S.C. 154(b) by 0 days.

(21) Appl. No.: 10/218,355

(22) Filed: Aug. 14, 2002

(65) Prior Publication Data

US 2004/0031125 A1 Feb. 19, 2004

(51) Int. Cl.[7] ..... E05D 15/32
(52) U.S. Cl. ..... 16/370; 16/366; 16/368
(58) Field of Search ..... 16/365, 366, 369, 16/370

(56) References Cited

U.S. PATENT DOCUMENTS

| | | | | | |
|---|---|---|---|---|---|
| 1,078,786 | A | | 11/1913 | Hanba et al. | |
| 1,593,930 | A | | 7/1926 | Carrier | |
| 1,817,113 | A | * | 8/1931 | Sipe | 270/39.05 |
| 1,984,092 | A | * | 12/1934 | Soss | 16/369 |
| 2,135,280 | A | * | 11/1938 | Erickson | 16/369 |
| 2,564,988 | A | | 8/1951 | Muller | |
| 2,686,332 | A | * | 8/1954 | Tull et al. | 16/369 |
| 2,779,069 | A | * | 1/1957 | Ziesmer | 16/364 |
| 2,882,004 | A | * | 4/1959 | Leishman | 16/366 |
| 2,901,766 | A | | 9/1959 | Marquis | |
| 4,499,631 | A | | 2/1985 | Lautenschläager | |
| 4,703,540 | A | * | 11/1987 | Davis | 16/337 |
| 4,756,054 | A | * | 7/1988 | Mitts et al. | 16/237 |
| 4,848,244 | A | * | 7/1989 | Bennett | 16/370 |
| 4,873,743 | A | | 10/1989 | Toyama | |
| 5,450,654 | A | | 9/1995 | Sullivan | |
| 5,491,875 | A | | 2/1996 | Siladke et al. | |
| 6,175,991 | B1 | | 1/2001 | Driesman et al. | |
| 6,212,827 | B1 | * | 4/2001 | Miller | 16/366 |

FOREIGN PATENT DOCUMENTS

| | | | | |
|---|---|---|---|---|
| DE | 43 08 675 A1 | | 9/1994 | |
| EP | 0 402 235 A1 | | 12/1990 | |
| EP | 565900 A1 | * | 10/1993 | E05D/3/06 |
| SU | 1680917 A1 | | 9/1991 | |

* cited by examiner

*Primary Examiner*—Lloyd A. Gall
*Assistant Examiner*—Christopher Boswell
(74) *Attorney, Agent, or Firm*—Hahn Loeser & Parks, LLP; Robert J. Clark

(57) ABSTRACT

An improved swing away style door hinge utilizing three articulated hinge members and a means for controlling the position of at least one of the hinge members with respect to at least one other hinge member such that the hinge allows greater access through a doorway when the door is opened at a 90 degree angle.

23 Claims, 6 Drawing Sheets

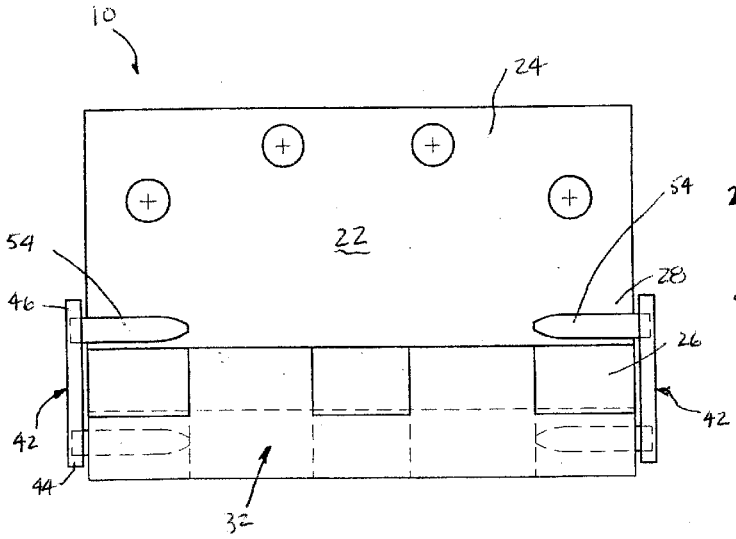
FIG. 5B
FIG. 5A
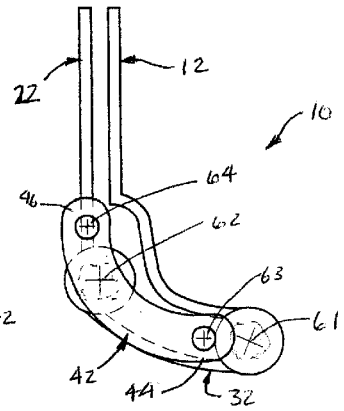
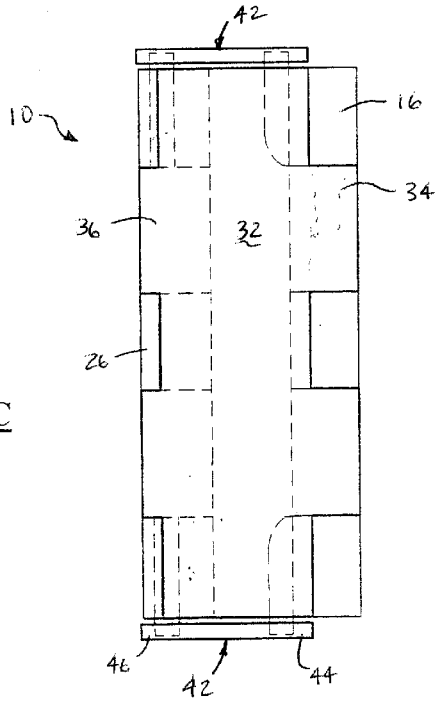
FIG. 5C

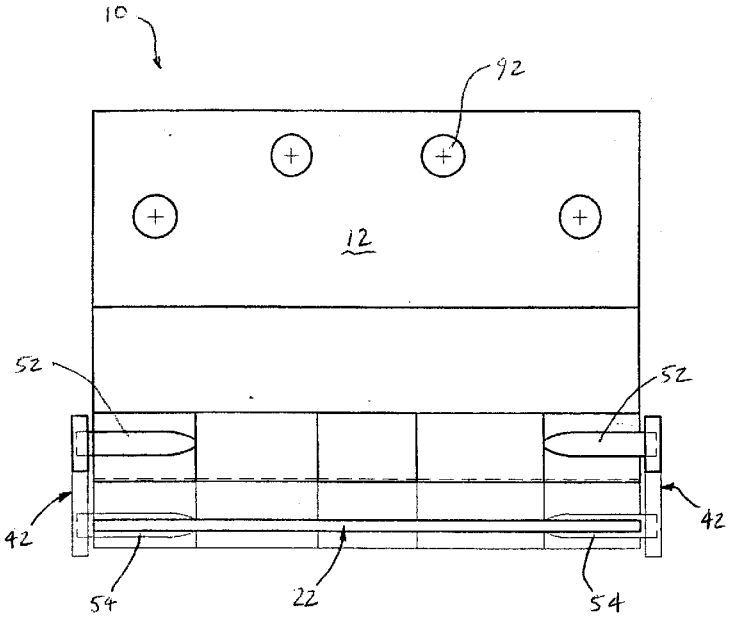
FIG. 6B
FIG. 6A
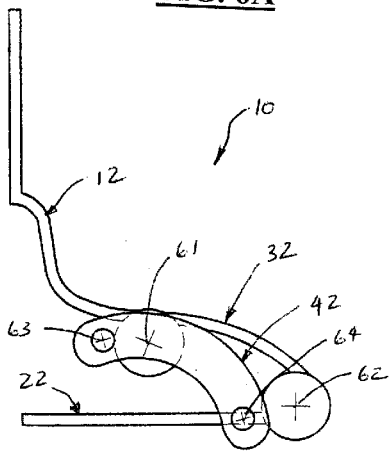
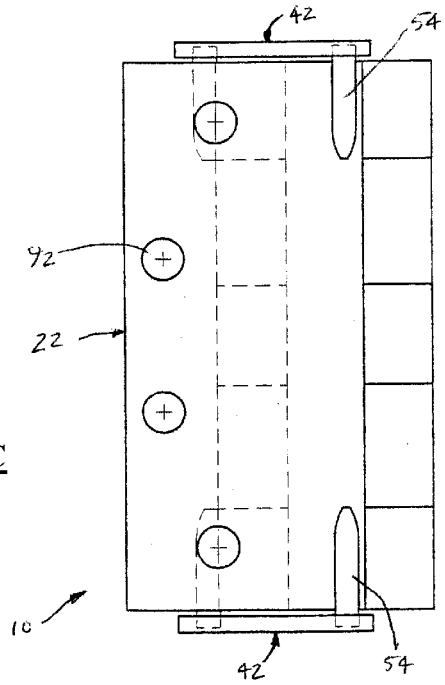
FIG. 6C

ARTICULATED SWING AWAY HINGE

FIELD OF THE INVENTION

The present invention relates generally to hinges and more particularly, to an articulated, swing away hinge which allows greater access through a doorway, directly replaces standard existing hinges, and is an aesthetically pleasing hinge. The present invention also relates to concurrently filed patent applications by the same inventor, application Ser. No. 60/403,350 entitled GEARED SWING AWAY HINGE and application Ser. No. 10/218,356 entitled FOUR PIVOT SWING AWAY HINGE, both herein incorporated by reference.

BACKGROUND OF THE INVENTION

The most common standard door hinge is a butt hinge which comprises two plates or leaves hingedly attached to each other about a single pivot point. A typical prior art butt hinge 100 is shown in FIG. 1A and comprises a door side leaf 102 and a jamb side leaf 104. The door side leaf 102 is typically mortised into a heel or edge 110 of the door 106 and the jamb side leaf 104 is typically mortised into jamb 108 of the doorway. Each of the leaves 102, 104 are further provided with a plurality of apertures (not shown) for passage of screws therethrough in order to attach the door side leaf 102 to the door heel or edge 110 and the jamb side leaf 104 to the door jamb 108. The leaves 102, 104 each have one or more rolled, tubular segments or knuckles (not shown) along a side edge. The knuckles of each leaf 102, 104 are specifically sized and arranged so as to mesh in axial alignment with the knuckles of the other leaf, thereby forming a hinge bone. A pin 112 is inserted through the axially aligned knuckles to effectively couple the leaves 102, 104 so that they are movable relative to one another about a common axis, defined by the hinge pin 112.

A problem with the standard butt hinge 100 is that when the door 106 is open at a 90 degree angle as shown in FIG. 1A, the entire door 106 is in the doorway thereby cutting down the available width or access through the doorway clearance space. The doorway clearance space 107 is generally defined as the space between two parallel planes 109, wherein each plane 109 is co-planar to a corresponding front face 111 of a door stop 113 on either side of the doorway as best shown in FIG. 1B. The problem is further accentuated by the fact that it is preferred in architectural design to place doorways near a corner of the room in order to cut down on lost room/wall available space, promote airflow in the structure, etc., as shown in FIG. 1B. The result is that the hinge side of the doorway may have a wall 130 perpendicular to the doorway wall 128 which limits the door movement to significantly less than the 180 degrees needed to clear the door 106 from the doorway clearance space 108. This requires that the door 106 is removed from the doorway by disconnecting all the hinges 100 any time furniture or other larger objects are needed to be moved through the doorway.

One attempt to solve the door clearance problem is the swing away or offset hinge. The offset hinge also comprises two leaves in the form of brackets hingedly attached to each other about a single pivot point such that the brackets nest in each other when the door is closed. As shown in FIG. 2, the offset hinge 120 has a pivot point formed by the hinge pin 112 which is significantly offset away from the doorjamb 108. When the door is opened at 90 degrees, the door is no longer in the doorway clearance space 108. However, several problems with the offset hinge 120 have prevented the use of the offset hinge 120 in most applications other than hospitals and other functional based environments. The offset hinge 120 is not aesthetically pleasing. The bracket leaves 122, 124 must extend completely over the casing of the doorway in order to enable the door to swing out of the passageway. The operation of the brackets 122, 124 place the door 106 at a significant distance from the doorway when the door 106 is opened at 90 degrees. This results in large moment, compressive, and tensile forces acting on the hinges 120 due to the weight and position of the door 106. This requires that the brackets 122, 124 are oversized to compensate for the strength requirement, or that additional hinges 120 are used to mount the door 106. In addition, the entire surface of both bracket leaves 122, 124 are visible when the door is opened making the offset hinge 120 even more aesthetically unpleasing and is a potential hazard to children.

In view of the above noted problems as well as other problems associated with prior art hinges, there remains a need in the art for an aesthetically pleasing hinge assembly which moves the door out of the doorway when the door is opened at a 90 degree angle.

SUMMARY OF THE INVENTION

It is an object of the invention to provide an improved hinge utilizing a plurality of hinged pivot points which overcomes at least one deficiency in the prior art. These and other advantages are provided by a hinge comprising: a first hinge member having a first generally planar end portion having a plurality of attachment holes, a second end portion, and an intermediate portion between the first end portion and the second end portion; a second hinge member having a first end, a second end, and plurality of attachment holes formed between the first end and the second end; a third hinge member having a first end hingedly attached to the second end of the first hinge member and a second end hingedly attached to the second end of the second hinge member; and a means for controlling the position of the second hinge member with respect to the first hinge member; wherein the hinge is movable from a closed position wherein the second hinge member and the first end portion of the first hinge member are generally parallel to each other to at least an open position wherein the second hinge member and the first end portion of the first hinge member are generally perpendicular to each other.

These and other advantages are also provided by a hinge for attachment of a door to a door jamb of a doorway, the doorway having a clearance space defined by the space between two parallel planes, each plane tangent to a corresponding front face of a door stop on either side of the doorway, the hinge comprising: a first hinge member fixably attached to the door jamb; a second hinge member fixably attached to the door; a third hinge member having a first end hingedly attached to the first hinge member at a first hinge point and a second end hingedly attached to the second hinge member at a second hinge point; wherein the second hinge point is rotatable about the first hinge point; and a means for controlling the position of the second hinge member with respect to the first hinge member; wherein the door is positioned outside of the doorway clearance space when the door is opened 90 degrees.

These and other advantages of the present invention will be apparent as described below and in relation to the drawings.

BRIEF DESCRIPTION OF THE DRAWINGS

Better understanding of the present invention will be had when reference is made to the accompanying drawings, wherein identical parts are identified with identical reference numerals, and wherein:

FIG. 5A is an end view of the hinge of the present invention shown in the closed position;

FIG. 5B is a door jamb side elevational view of the hinge of the present invention shown in the closed position;

FIG. 5C is a wall side elevational view of the hinge of the present invention shown in the closed position;

FIG. 6A is an end view of the hinge of the present invention shown in the open position;

FIG. 6B is a door jamb side elevational view of the hinge of the present invention shown in the open position; and FIG. 6C is a wall side elevational view of the hinge of the present invention shown in the closed position.

DETAILED DESCRIPTION OF THE DRAWINGS

Figure 1A:
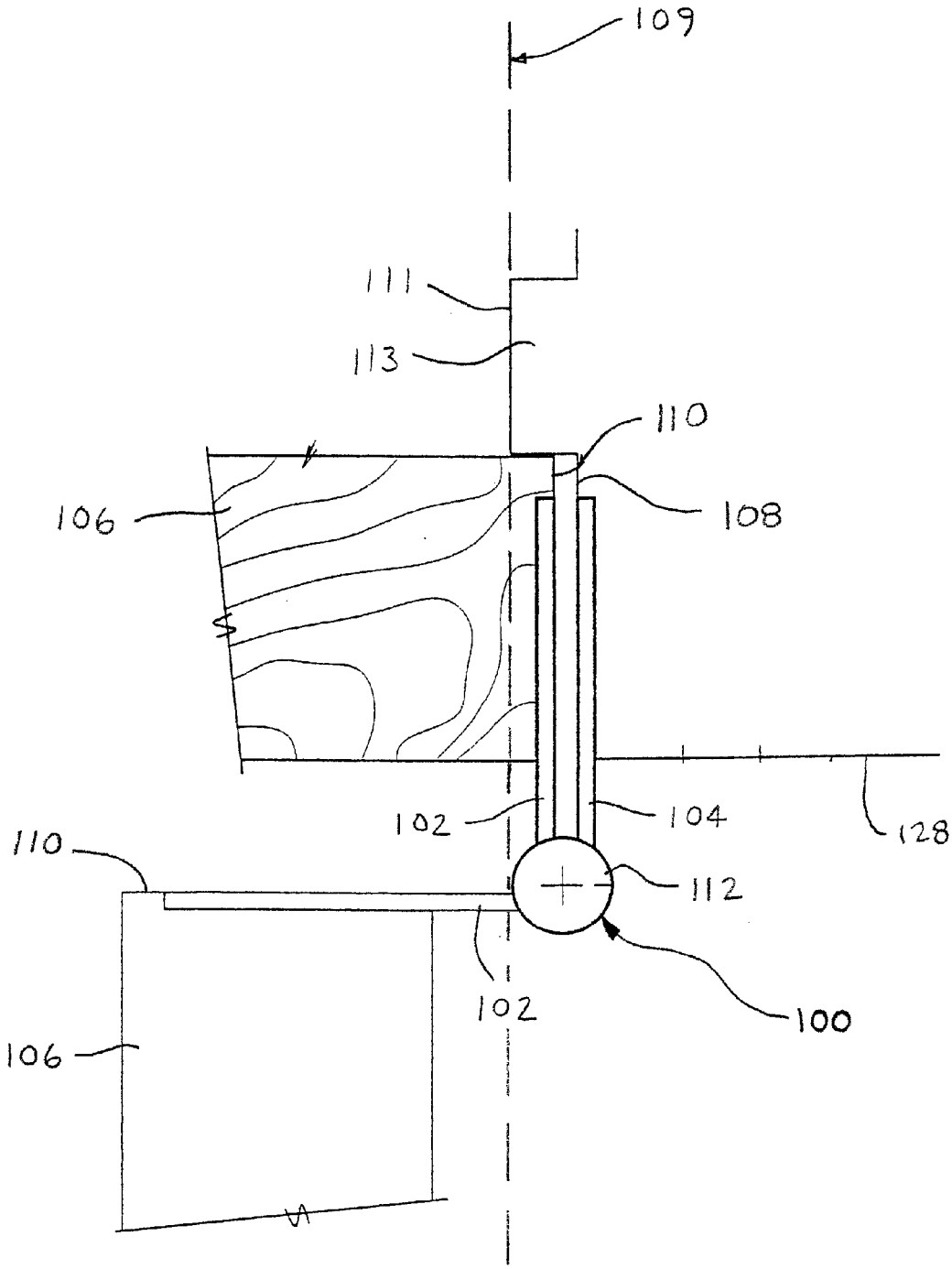
PRIOR ART FIG. 1A
FIG. 1A is an end view of a standard prior art butt hinge attached in mortise fashion to a door and a door jamb shown with the door closed and opened at 90 degrees.
Figure 1B:
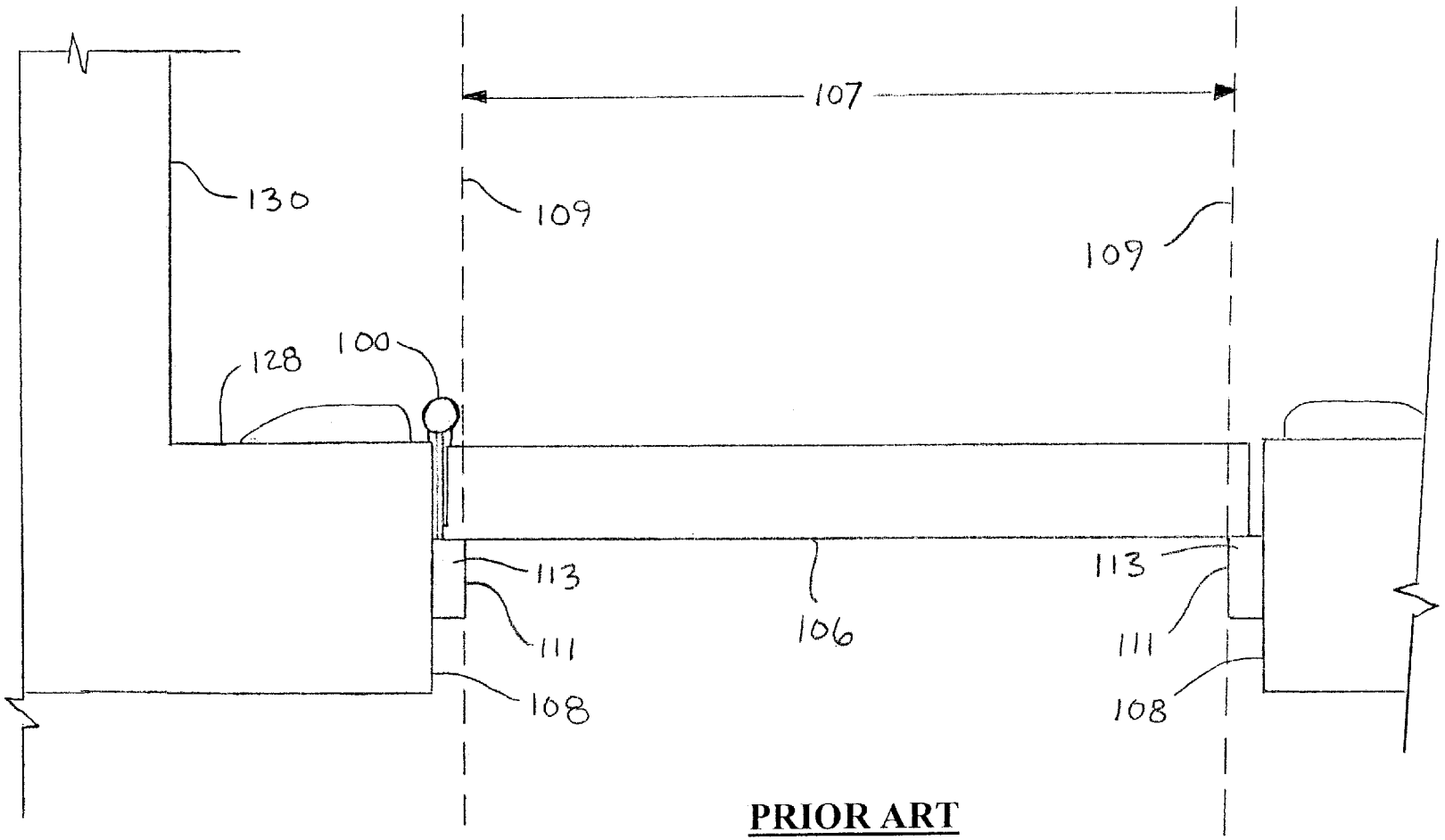
PRIOR ART FIG. 1B
FIG 1B shows a standard prior art butt hinge attached in mortise fashion to a door and a door jamb with the door positioned in a doorway in a closed position.
Figure 2:
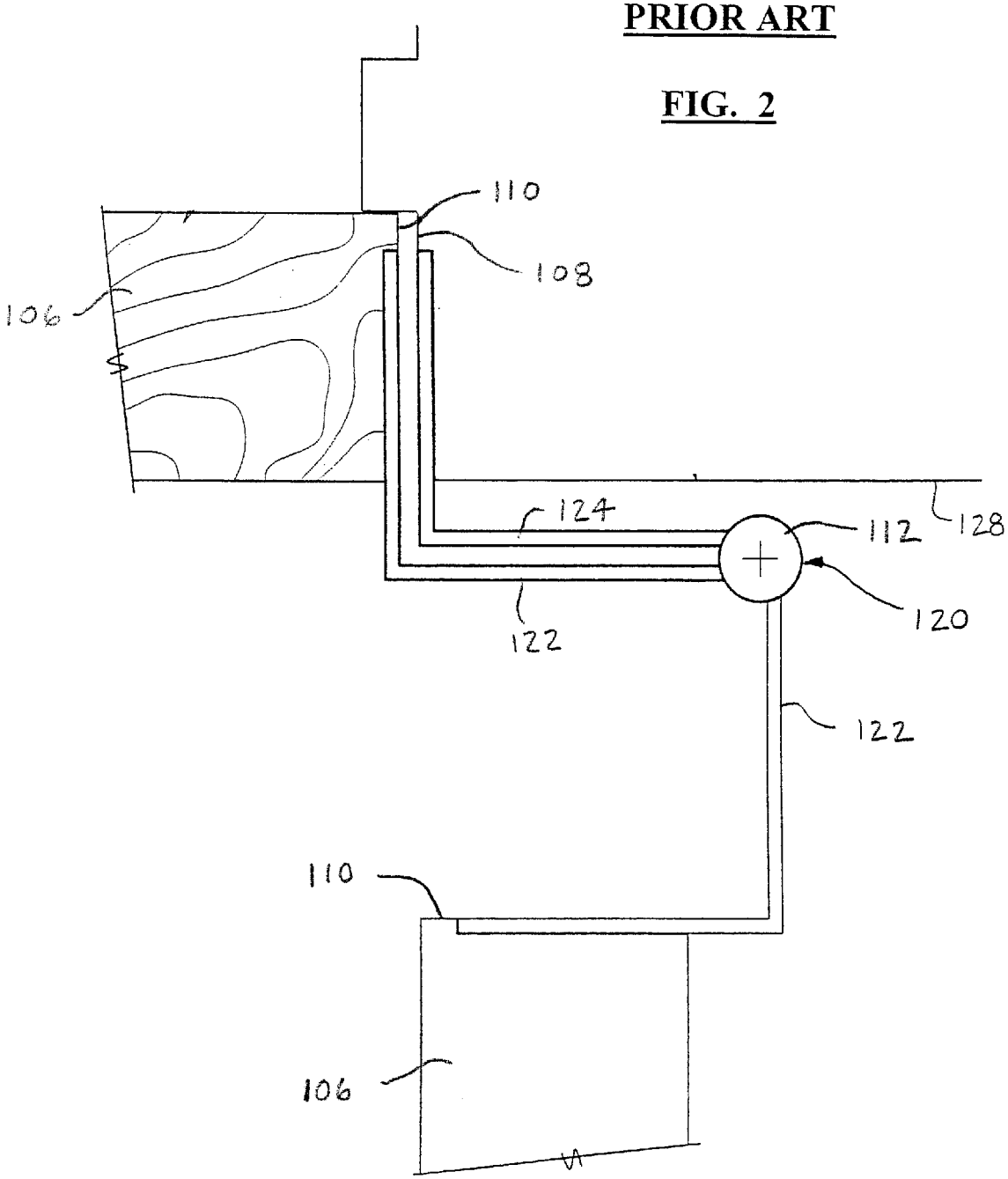
PRIOR ART FIG. 2
FIG. 2 is an end view of a prior art offset hinge attached to a in mortise fashion door and a door jamb shown with the door closed and door opened at 90 degrees.
Figure 4:
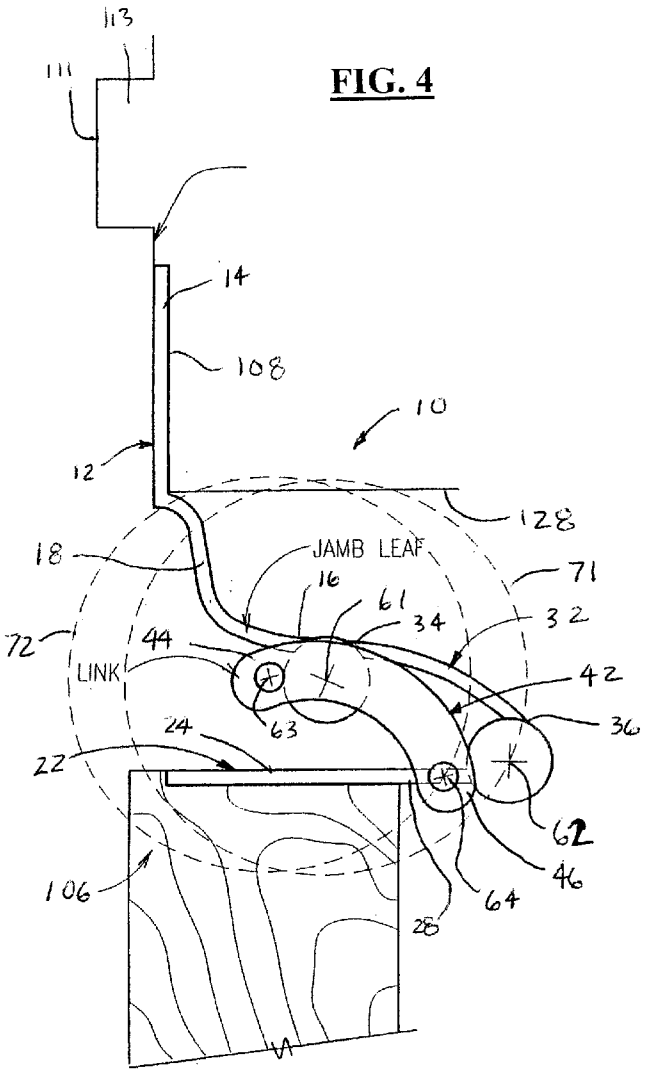
FIG. 4 is an end view of the hinge of the present invention attached in mortise fashion to a door and a door jamb shown in the door open position.
Figure 3:
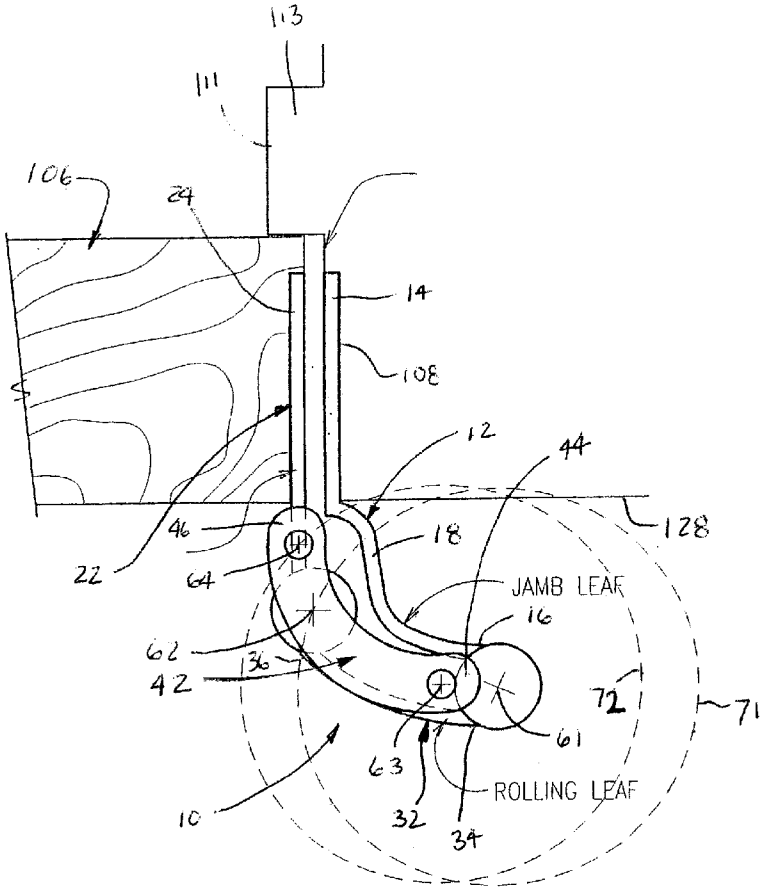
FIG. 3 is an end view of the hinge of the present invention attached in mortise fashion to a door and a door jamb shown in the door closed position.

Referring now to FIGS. 3 and 4, the hinge 10 of the present invention is shown attaching a door 106 to a door jamb 108 in a door closed position and a door open position, respectively. The hinge 10 comprises a first hinge member 12 fixably attached to the door jamb 108, a second hinge member 22 fixably attached to the door 106, and a third hinge member 32 having a first end 34 hingedly attached to the first hinge member 12 at a first hinge point 61 and a second end 36 hingedly attached to the second hinge member 22 at a second hinge point 62. Hinge 10 also comprises a means 42 for controlling the relative positions of the first hinge member 12 and the second hinge member 22. The means 42 for controlling the relative positions may comprise at least one fourth hinge member 42 having a first end 42 hingedly attached to the first hinge member 12 and a second end 44 hingedly attached to second hinge member 32.

The first hinge member 12 comprises a first generally planar portion 14 fixably attached to the door jamb 108, a second end portion 16, and an intermediate portion 18. The first hinge member 12 is configured generally as an obtuse angle such that the second end portion 16 and intermediate portion 18 are angled from the planar first portion 14 away from the door 106 and away from wall 128 when the door 106 is in the closed position. The intermediate portion 18 is configured to provide clearance for a casing (not shown) which may be attached to the wall 128. The second end portion 16 of the first hinge member 12 is positioned and configured to provide a point of rotation that in conjunction with the remainder of hinge 10, allows the door 106 to swing out of the doorway clearance space 109 when the door is opened 90 degrees. The second end portion 16 of the first hinge member 12 comprises at least one knuckle portion 16 as best shown in FIGS. 5C and 6B.

Referring again to FIGS. 3 and 4, the second hinge member 22 comprises a first end portion 24 fixably attached to the door 106, a second end portion 26 and an intermediate portion 28 between the first end portion 24 and the second end portion 26. The second end portion 26 of the second hinge member 22 comprises at least one knuckle portion 26. The first portions 24, 14 of the second and first hinge members 22, 12 each include a plurality of apertures 92 for attachment to the door and door jamb, respectively. When the present hinge 10 is used for retro-fitting an existing hinge, the apertures 92 are preferably positioned in different locations than the apertures of the existing hinge. This allows a new tight connection as compared to looseness that may accompany the use of old holes in the door 106 and/or door jamb 108. The first portions 14, 24 of the first and second hinge members 12, 22 are generally the same size and thickness as the leaves 102, 104 of a standard butt hinge 120. This enables the standard door mortise to be used such that little or no additional machining is required. It is important that the distance between the door heel 110 and the door jamb 108 remains generally the same as with a standard butt hinge 120, especially when retro-fitting standard butt hinge 120 with the hinge of the present invention 10. This ensures that the strike side of the door 106 properly engages and that the door 106 operates properly.

The third hinge member 32 comprises a first end 34 hingedly attached the second portion 16 of the first hinge member 12 and a second end 34 hingedly attached to the second end 26 of the second hinge member 22. Hinge member 32 also comprises an intermediate portion 38 between the first end 34 and second end 36 of hinge member 32. The third hinge member 32 provides an articulated connection between the first hinge member 12 and the second hinge member 22. The first end 34 and second end 36 of hinge member 32 generally comprise at least one knuckle portion 34, 36 to provide a hinged attachment to the other hinge members 12, 22.

FIGS. 3 and 4 show the general range of motion of the hinge 10. The hinged attachments of the hinge members is generally accomplished by a hinge pin positioned through axially aligned knuckles to effectively couple the leaves about a common axis or pivot point defined by the hinge pin as best shown with respect to FIGS. 4A–5C. Referring again to FIGS. 3 and 4, the first hinge pivot point 61 is formed by the attachment of the second end 16 of the first hinge member 12 to the first end 34 of the third hinge member 32. Pivot point 61 or hinge pin 61, is fixed in position. The second pivot point 62 is formed by the attachment of the second end 36 of the third hinge member 32 to the second end 26 of the second hinge member 22. Pivot point 62 is able to rotate in an arc 71 about the fixed first pivot point 61.

The second hinge member rotates about the second pivot point 62. However, a means 42 for controlling the position of the door 106 is needed to move the door 106 out of the doorway 108. Means 42 may be provided by the at least one fourth hinge member 42. The first end 44 of the fourth hinge member 42 is pivotally attached to the second end 16 of the first hinge member 12 at pivot point 63 and the second end 46 is pivotally attached to the intermediate portion 28 of the second hinge member 12 at pivot point 64. Pivot point 64 is able to rotate in an arc 72 about the fixed pivot point 63.

As best shown in FIGS. 5A–6C, the hinge members 12, 22, and 32, each have one or more rolled, tubular segments or knuckles 16, 26, 34 and 36. The knuckles 16, 26, 34 and 36 of each hinge member 12, 22, and 32, are specifically sized and arranged so as to mesh in axial alignment with the knuckles of an adjacent hinge member, thereby forming a hinge bone. Hinge pins (not shown) are inserted through the axially aligned knuckles 16, 26, 34 and 36 to effectively couple the hinge members 12, 22, 32 so that they are movable relative to one another about a common axis, defined by the pivot points 61 and 62.

The fourth hinge member 42 of hinge 10 is formed as at least one link member 42 and preferably two link members 42 positioned above and below the hinge 10. Being positioned in different planes, the link members 42 are able to slide over the other hinge members 12, 22, 32 and not limit the movement of the hinge 10. Instead of being connected by hinge pins through a plurality of intermeshing knuckles, the fourth hinge member 42 is pivotally attached at pivot point 63 and 64 by a pin attachment. A pin 52 is attached to opposite ends of the knuckle portion 16 of the first hinge member 12 and extends above and below the hinge member 12 for attachment of the first ends 44 of the fourth hinge member 42. A pin 54 is attached to opposite ends of the intermediate portion 28 of the second hinge member 22 and extends above and below the hinge member 22 for attachment of the second ends 46 of the fourth hinge member 42. Pin 54 is generally adjacent the second end 26 of the second hinge member and it is contemplated that pin 54 could be fixably attached to second end 26 similar to that of pin 52. Although not shown, it is further contemplated that the fourth hinge member 42 could be positioned between the top and bottom of the hinge 10 such as, for example, a centrally located position utilizing a single fourth hinge member 42.

In operation of the hinge 10, the door 106 is fixably attached to the second hinge member 22 which has first end 24 rotatable about pivot point 62 and intermediate portion 28 rotatable about pivot point 64. The kinematical relationship of the hinge members allows the door to be completely out of doorway clearance space 108 when the door 106 is opened about 90 degrees. In addition, the door 106 is generally 30% closer to the wall 128 than a comparable offset hinge 120. The four pivot points 61–64 generally form a quadrilateral and provide increased strength to the hinge 10. In contrast, this provides a significant strength advantage over the single offset pivot point 112 of the offset hinge 120 which is positioned a much greater distance from the door 106. The single offset hinge point 112 must endure the entire weight of the door compounded by the moment effect of the distance of the door from the hinge point 112.

Hinge 10 is aesthetically pleasing. In the door closed position, hinge 10 has a minimized surface area "footprint" as shown in FIG. 5C, which is much smaller that the large surface area footprint of the offset hinge 120. The curved surfaces of the third hinge member 32 and of portions of the first hinge member 12 also provide an enhanced look to the hinge 10.

Although the present invention has been described above in detail, the same is by way of illustration and example only and is not to be taken as a limitation on the present invention. It is contemplated that modifications and changes can be made without departing from the scope of the present invention. Accordingly, the scope and content of the present invention are to be defined only by the terms of the appended claims.

What is claimed is:

1. A hinge for attachment of a door to a jamb attachment face of a door jamb of a doorway, the doorway having a clearance space defined by the space between two parallel planes, each plane tangent to a corresponding front face of a door stop on either side of the doorway, the hinge comprising:

a first hinge member fixably attached to the door jamb;

a second hinge member fixably attached to the door;

a third hinge member having a first end hingedly attached to the first hinge member at a first hinge point and a second end hingedly attached to the second hinge member at a second hinge point;

wherein the second hinge point is rotatable about the first hinge point; and a fourth hinge member pivotally attached to the first hinge member at a third hinge point generally adjacent the first hinge point and pivotally attached to the second hinge member at a fourth hinge point generally adjacent the second hinge point;

wherein the fourth hinge point is rotatable about the third hinge point;

wherein the door is positioned outside of the doorway clearance space when the door is opened 90 degrees and moveable to a position wherein the second hinge member is completely on the jamb side of the jamb attachment face.

2. The hinge of claim 1, wherein the fourth hinge member is positioned on a top end of the hinge.

3. The hinge of claim 2, wherein the fourth hinge member comprises a first fourth hinge member and a second fourth hinge member wherein the first fourth hinge member is positioned on a top end of the hinge and the second fourth hinge member is positioned on a bottom end of the hinge.

4. The hinge of claim 1, wherein a first end of the fourth hinge member is pivotally attached to a pin extending from the second hinge member.

5. The hinge of claim 4, wherein the pin extending from the second hinge member is positioned on the second hinge member at a location between the attachment of the second hinge member to the door and the pivotal attachment location of the third hinge member to the second hinge member.

6. The hinge of claim 1, wherein a second end of the fourth hinge member is pivotally attached to a pin fixably attached to and extending from the first hinge member.

7. A hinge comprising:

a first hinge member having a first generally planar end portion having an attachment face side, an exposed side opposite the attachment base side, and a plurality of attachment holes, a second end portion, and an intermediate portion between the first end portion and the second end portion;

a second hinge member having a first end, a second end, and plurality of attachment holes formed between the first end and the second end;

a third hinge member having a first end hingedly attached to the second end of the first hinge member and a second end hingedly attached to the second end of the second hinge member; and at least one fourth hinge member pivotally attached to the first hinge member at a third hinge point proximate the first hinge point and pivotally attached to the second hinge member at a fourth hinge point proximate the second hinge point;

wherein the hinge is movable from a closed position wherein the second hinge member and the first end portion of the first hinge member are generally parallel to each other to at least an open position wherein the second hinge member and the first end portion of the first hinge member are generally perpendicular to each other such that the second hinge member is generally positioned on the attachment side of the first end portion of the first hinge member.

8. The hinge of claim 7, wherein the fourth hinge member is positioned on a top end of the hinge.

9. The hinge of claim 7, wherein the fourth hinge member comprises a pair of fourth hinge members wherein a first fourth hinge member is positioned on a top end of the hinge and a second fourth hinge member is positioned on a bottom end of the hinge.

10. The hinge of claim 7, wherein the intermediate portion and second end of the first hinge member are generally formed at an obtuse angle with the generally planar first end of the first hinge member.

11. A hinge for attachment of a door to a jamb attachment face of a door jamb of a doorway, the doorway having a clearance space defined by the space between two parallel planes, each plane co-planar with a corresponding front face of a door stop on either side of the doorway, the hinge comprising:

a first hinge member fixably attached to the door jamb;

a second hinge member fixably attached to the door, a third hinge member having a first end hingedly attached to the first hinge member and a second end hingedly attached to the second hinge member; and at least one fourth hinge member positioned generally perpendicular to the first, second and third hinge members, having a first end pivotally attached to the second hinge member and a second end pivotally attached to the first hinge member;

wherein the door is positioned outside of the doorway clearance space when the door is opened 90 degrees and moveable to a position wherein the second hinge member is completely on the jamb side of the jamb attachment face.

12. The hinge of claim 11, wherein the first hinge member comprises a first generally planar end portion fixably attached to the door jamb, a second end portion including at least one knuckle, and an intermediate portion between the first end portion.

13. The hinge of claim 12, wherein the second end portion and the intermediate portion of the first hinge member are generally formed at an obtuse angle with the generally planar first end of the first hinge member.

14. The hinge of claim 11, wherein the first end of the fourth hinge member is attached to a pin extending from the second hinge member.

15. The hinge of claim 14, wherein the pin extending from the second hinge member is positioned on the second hinge member at point between the attachment of the second hinge member to the door and the hinged connection of the third hinge member to the second hinge member.

16. The hinge of claim 11, wherein the second end of the fourth hinge member is attached to a pin fixably attached to and extending from the knuckle of the second end of the first hinge member.

17. The hinge of claim 16, wherein the pin fixably attached to and extending from the knuckle of the second end of the first hinge member is attached to a doorway side of the knuckle at a position between the third hinge member and the intermediate portion of the first hinge when the hinge is positioned in a door closed configuration.

18. The hinge of claim 11, wherein the at least one fourth hinge member comprises a first fourth hinge member and a second fourth hinge member;

wherein the first fourth hinge member is attached on a top side of the first and second hinge members; and wherein the second fourth hinge member is attached on a bottom side of the first and second hinge members.

19. The hinge of claim 18, wherein a first end of the first fourth hinge member is pivotally attached to a pin extending from the top side of the second hinge member and the first end of the second fourth hinge member is pivotally attached to a pin extending from the bottom side of the second hinge member.

20. The hinge of claim 18, wherein the second end of the first fourth hinge member is pivotally attached to a pin fixably attached to and extending from a top side of a first knuckle formed on a second end of the first hinge member and the second end of the second fourth hinge member is pivotally attached to a pin fixably attached to and extending from a bottom side of a second knuckle formed on the second end of the first hinge member.

21. A hinge for attachment of a door to a jamb attachment face of a door jamb of a doorway, the doorway having a clearance space defined by the space between two parallel planes, each plane co-planar with a corresponding front face of a door stop on either side of the doorway, the hinge comprising:

a first hinge member comprising a first generally planar end portion fixably attached to the door jamb, a second end portion forming a plurality of knuckles, and an intermediate portion between the first end portion and the second end portion;

a second hinge member comprising a first generally planar end portion fixably attached to the door, a second end portion forming a plurality of knuckles, and an intermediate portion between the first end portion and the second end portion;

a third hinge member having a first end hingedly attached the second end of the first hinge member and a second end hingedly attached to the second end of the second hinge member; and at least one fourth hinge member having a first end pivotally attached to a pin extending from a top side of the intermediate portion of the second hinge member and a second end pivotally attached to a pin fixably attached to and extending from a top side of a first knuckle formed on the second end of the first hinge member;

wherein the door is positioned outside of the doorway clearance space when the door is opened 90 degrees and moveable to a position wherein the second hinge member is completely on the jamb side of the jamb attachment face.

22. The hinge of claim 21, further comprising a second fourth hinge member having a first end pivotally attached to a pin extending from a bottom side of the intermediate portion of the second hinge member and a second end pivotally attached to a pin fixably attached to and extending from a bottom side of a second knuckle formed on the second end of the first hinge member.

23. A hinge comprising:

a first hinge member having a first generally planar end portion having a plurality of attachment holes, a second end portion, and an intermediate portion between the first end portion and the second end portion;

a second hinge member having a first end, a second end, and plurality of attachment holes formed between the first end and the second end;

a third hinge member having a first end hingedly attached to the second end of the first hinge member at a first hinge point and a second end hingedly attached to the second end of the second hinge member at a second hinge point, wherein the second hinge point is rotatable about the first hinge point; and at least one fourth hinge member pivotally attached to the first hinge member at a third hinge point proximate the first hinge point and pivotally attached to the second hinge member at a fourth hinge point proximate the second hinge point, wherein the fourth hinge point is rotatable about the third hinge point;

wherein the second hinge point rotates in a counter-clockwise direction about the first hinge point and the fourth hinge point rotates in a counter-clockwise direction about the third hinge point when the door is moved from a closed position to an open position when the hinge is installed as a right hinge and wherein the second hinge point rotates in a clockwise direction about the first hinge point and the fourth hinge point rotates in a clockwise direction about the third hinge point when the door is moved from a closed position to an open position when the hinge is installed as a left hinge.

* * * * *